US005553919A

United States Patent [19]

Dennis

[11] Patent Number: 5,553,919

[45] Date of Patent: Sep. 10, 1996

[54] SCISSOR JACK LUMBAR SUPPORT

[75] Inventor: Michael R. Dennis, Rochester Hill, Mich.

[73] Assignee: Excellence Lumbar Corporation, Grand Rapids, Mich.

[21] Appl. No.: 321,961

[22] Filed: Oct. 11, 1994

[51] Int. Cl.[6] ..... A47C 7/46

[52] U.S. Cl. ..... 297/284.8

[58] Field of Search ..... 297/284.4, 284.1, 297/284.8, 344.13, 284.8; 248/421

[56] References Cited

U.S. PATENT DOCUMENTS

| | | | |
|---|---|---|---|
| 1,182,854 | 5/1916 | Poler . | |
| 3,195,955 | 7/1965 | Richardson et al. . | |
| 3,724,797 | 4/1973 | Freitag et al. | 248/421 |
| 3,797,886 | 3/1974 | Griffiths . | |
| 4,050,738 | 9/1977 | Griffiths . | |
| 4,121,802 | 10/1978 | Kluting et al. | 248/421 |
| 4,171,125 | 10/1979 | Griffiths . | |
| 4,172,589 | 10/1979 | Griffiths . | |
| 4,231,615 | 11/1980 | Griffiths . | |
| 4,313,637 | 2/1982 | Barley | 297/284.4 |
| 4,316,631 | 2/1982 | Lenz et al. . | |
| 4,339,150 | 7/1982 | McNamara et al. | 297/284.8 |
| 4,354,709 | 10/1982 | Schustee | 297/284.4 |
| 4,368,917 | 1/1983 | Urai . | |
| 4,452,485 | 6/1984 | Schuster . | |
| 4,506,814 | 3/1985 | Adorui | 248/421 |
| 4,627,661 | 12/1986 | Ronnhult et al. . | |
| 4,762,367 | 8/1988 | Denton | 297/284.4 |
| 4,995,580 | 2/1991 | Fujii | 248/421 |
| 5,020,855 | 6/1991 | Lundberg et al. | 297/284.1 |
| 5,088,790 | 2/1992 | Wainwright et al. | 297/284.4 |
| 5,197,780 | 3/1993 | Coughlin | 297/284.4 |
| 5,224,757 | 7/1993 | Geitz et al. . | |
| 5,240,308 | 8/1993 | Goldstein et al. | 297/284.8 |

FOREIGN PATENT DOCUMENTS

| | | |
|---|---|---|
| 18059 | 2/1984 | Australia . |
| 1274003 | 7/1968 | Germany . |
| 2541559 | 3/1977 | Germany . |
| 2935352 | 3/1980 | Germany . |
| 1365348 | 9/1974 | United Kingdom . |
| 1508399 | 4/1978 | United Kingdom . |
| 1536132 | 12/1978 | United Kingdom . |
| 2059497 | 4/1981 | United Kingdom . |
| 2192333 | 1/1988 | United Kingdom . |
| 9313696 | 7/1993 | WIPO . |
| 9321800 | 11/1993 | WIPO . |

*Primary Examiner*—Peter M. Cuomo
*Assistant Examiner*—Anthony D. Barfield
*Attorney, Agent, or Firm*—Warner Norcross & Judd

[57] ABSTRACT

A lumbar support for a seat back having a support platform that extends and retracts by operation of lever arms. The present invention generally includes a support frame and a rigid support platform suspended within a seat back. The support platform is mounted to the support frame by lever arms preferably arranged in a scissors jack configuration. A control mechanism having a Bowden cable and a rotary control is provided to selectively pivot the levers and cause the support platform to extend and retract with respect to the support frame.

16 Claims, 4 Drawing Sheets

SCISSOR JACK LUMBAR SUPPORT

BACKGROUND OF THE INVENTION

The present invention relates to a lumbar support, and more particularly to a lumbar support for a seat back.

Lumbar supports have long been used to improve the comfort of conventional seats. Typically, the lumbar support is located in a lower portion of a seat back where it extends outwardly to provide support for the lower back or lumbar region. A lumbar support is usually provided with a regulator or control knob that allows the user to select the desired extension of the lumbar support.

A typical lumbar support includes a flexible support platform that is suspended within a seat back. Operation of a control knob located on the exterior of the seat allows the user to selectively draw together opposite ends of the support platform, thereby causing the platform to bow or flew into the lower back region. U.S. Pat. No. 4,627,661 to Rönnhult et al discloses a chair back with an adjustable lumbar support. The Rönnhult lumbar support includes a support platform having a number of horizontal connecting wires extending between a pair of vertical, flexible, rod-like side elements. A pair of tensioning members extend along opposite vertical edges of the support member. The two tensioning members are interconnected by a threaded shaft which, when rotated in a first direction, draws the tensioning members together, and, when rotated in the opposite direction, moves them farther apart. When the tensioning members are drawn together, they exert a compression or buckling force on the support platform which causes it to bow or flex outward into the lower back region.

Another typical lumbar support is disclosed in PCT Application No. WO 93/13696, published Jul. 22, 1993. This lumbar support includes upper and lower support platforms that are hingedly connected to one another. A tensioning device is provided to apply a compression force to the support platforms. The compression force draws the free ends of the two platforms together, thereby causing the interconnected edges to hinge outwardly into the lower region of the chair back.

These prior art lumbar supports have a relatively large vertical profile. As a result, they occupy a large portion of the seat back. In addition, the outward bowing or arching of the lumbar support causes a bulge of increasingly acute angle. Consequently, the support platform and seat cushioning must be specially adapted to prevent discomfort. Further, the forward deflection of the lumbar support is limited by the physical characteristics of the support platform.

SUMMARY OF THE INVENTION

The aforementioned problems are overcome by the present invention wherein a lumbar support is provided with a support platform that moves by operation of lever arms.

In a preferred embodiment, the present invention includes a support frame and a rigid support platform suspended within a seat back. The support platform is mounted to the support frame by two pair of lever arms arranged in a scissors jack configuration. A control mechanism is provided to control extension of the support platform. The control mechanism includes a Bowden cable adapted to pivot the lever arms thereby causing the support platform to extend and retract with respect to the support frame.

In an alternative embodiment, the lumbar support is provided with a reverse lever system. The reverse lever system includes two pair of L-shaped lever arms extending between the support frame and the support platform. The free end of the first leg of each lever arm is pivotally secured to the support platform. In addition, the vertex of each lever is pivotally secured to the support frame. And finally, the free end of the second leg of each lever arm is secured to a Bowden cable which can be extended or retracted to move the support platform.

The present invention provides a simple and effective lumbar support that has a relatively short vertical profile. In addition, the present invention includes a rigid support platform that is extended without flexing or bowing. As a result, extension of the support platform does not result in an uncomfortable bulge of increasingly acute angle. Further, the forward deflection of the lumbar support is controlled by the length and orientation of the lever arms rather than by the physical characteristics of the support platform.

These and other objects, advantages, and features of the present invention will be more fully understood and appreciated by reference to the detailed description of the preferred embodiment and the drawings.

DETAILED DESCRIPTION OF THE PREFERRED EMBODIMENT

Figure 1:
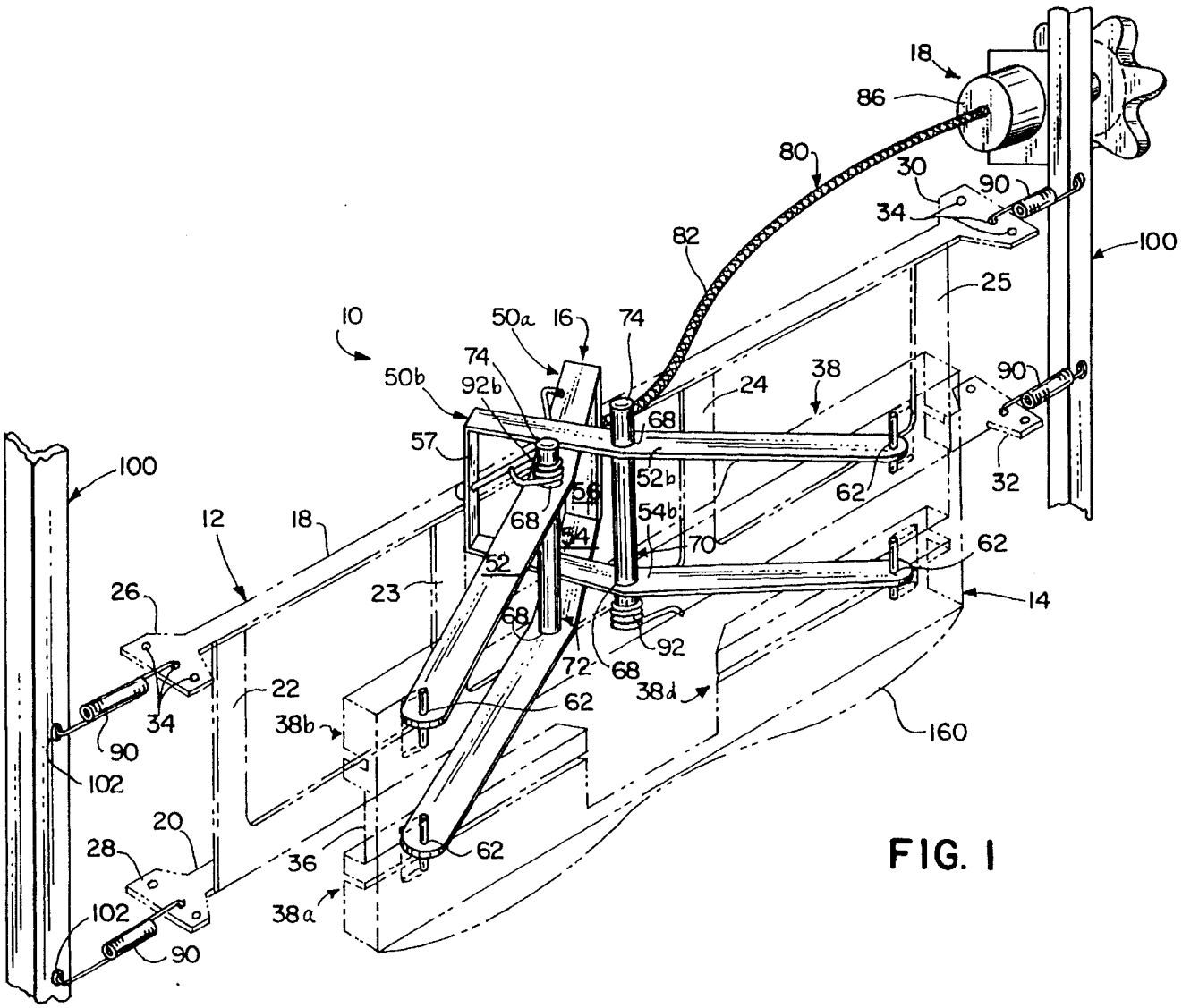
FIG. 1 is a perspective view of the lumbar support with portions shown in phantom lines.

A lumbar support constructed in accordance with a preferred embodiment of the present invention is illustrated in FIG. 1, and generally designated 10. The lumbar support 10 generally includes a support frame 12 suspended within a seat back, a support platform 14 carried by the support frame 12, lever arms 16 extending between the support frame 12 and support platform 14, and a control mechanism 18 for operating the lever arms 16 to selectively extend and retracted the support platform 14 with respect to the support frame 12.

The support frame 12 is preferably a one-piece stamped steel frame having a pair of substantially parallel, horizontal members 18 and 20, and a number of substantially parallel, vertical supports 22, 23, 24, and 25. A pair of spaced apart bores 74 extend through a central portion of each horizontal member 18 and 20. The vertical supports 22, 23, 24, and 25 are dimensioned to provide the frame with sufficient strength to withstand potential vehicle impact forces. Flange portions 26, 28, 30, and 32 extend from opposite longitudinal ends of each horizontal member 18 and 20. A series of bores 34 extend through each flange portion 26, 28, 30, and 32 to facilitate suspension of the support frame 12 in various positions as described below.

The support platform 14 generally includes a face plate 36 and four pair of mounting blocks 38*a–d*. The face plate 36 is preferably a generally flat, rectangular sheet dimensioned to fit within the opening defined by the support frame 12. If desired, a variety of windows or openings may be formed in the face plate 36 to reduce the weight of the lumbar support 10 (not shown). While the face plate 36 is preferably manufactured from injection molded plastic or stamped steel, a variety of other materials and method of construction will suffice. As noted above, the face plate 36 is preferably flat. However, it may be contoured to provide maximum comfort. Alternatively, a shaped pad 160 may be mounted to the face plate 36 to provide the desired contour (See FIGS. 1, 4, and 6). The pad 160 is preferably manufactured from foam or other similar materials.

Figure 2:
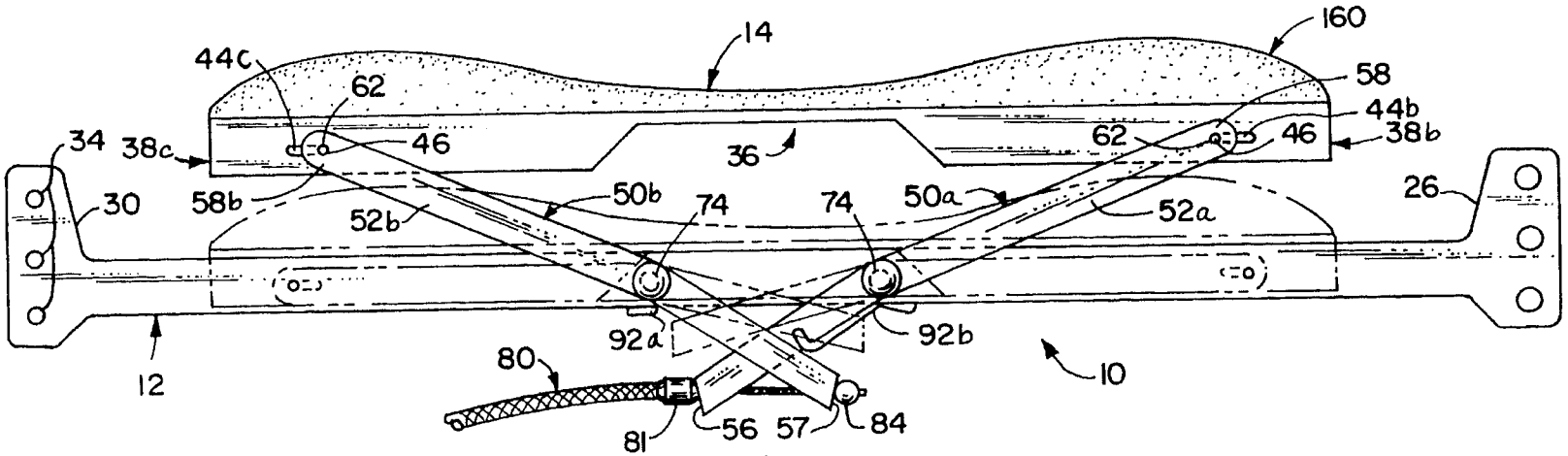
FIG. 2 is a top plan view of the lumbar support.

As perhaps best illustrated in FIG. 2, the four pair of mounting blocks 38*a–d* are preferably formed as an integral part of the face plate 36. Each pair of mounting blocks includes spaced apart, generally rectangular upper and lower blocks 40*a–d* and 42*a–d*. The upper and lower blocks 40*a–d* and 42*a–d* cooperate to define a number of channels 48*a–d* which receive the lever arms 16 as described below. In the preferred embodiment, channels 48*a* and 48*b* are horizontally offset from channels 48*c* and 48*d*, respectively. A slot 44*a–d* extends vertically through a central portion of each of the upper and lower blocks 40*a–d* and 42*a–d* to receive pins 46 as described below.

Figure 3:
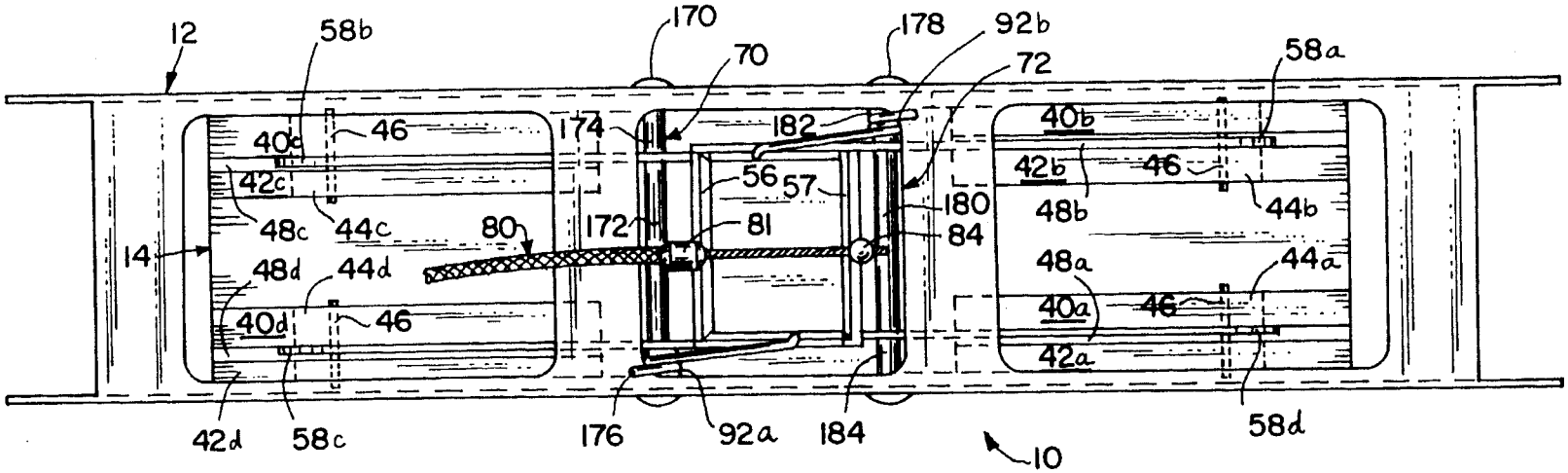
FIG. 3 is a rear view of the lumbar support.

In the preferred embodiment, the mounting blocks 38*a–d* are dimensioned to provide structural support to the face plate 36. While this is typically not necessary when the support platform 36 is manufactured from stamped steel, it is particularly beneficial when the support platform 14 is polymeric. For example, FIGS. 1–3 illustrate integral mounting blocks 38*a–d* that are extended in a lengthwise direction to provide longitudinal support for the face plate 36. In the alternative embodiment illustrated in FIGS. 4–6, the mounting blocks 38*a–d'* are fabricated separately and preferably snap-fit into openings (not shown) formed in a stamped steel face plate 36. In this embodiment, the mounting blocks 38*a–d'* are preferably manufactured from nylon or other durable, resilient materials. Another alternative is to provide metal mounting blocks that are fabricated separately and attached to the face plate by welding or other conventional methods.

In a preferred embodiment, the present invention includes two pair of one-piece lever arms 50*a–b* arranged in a scissors jack configuration (e.g. the lever arms overlap). Each pair of lever arms 50*a–b* is generally U-shaped and includes an upper arm 52*a–b*, a lower arm 54*a–b*, and an end member 56 and 57 extending therebetween. As perhaps best illustrated in FIG. 2, the upper and lower arms 52*a–b* and 54*a–b* are dog-legged (i.e. the include a bend and include a free end 58*a–d* that is pivotally secured to the mounting blocks 38*a–d*. The length of the arms 52*a–b* and 54*a–b* can be varied to control the maximum extension of the lumbar support 10. A bore 62 extends through the free end of each arm 52*a–b* and 54*a–b* to seat pin 46. A second bore 68 extends through the vertex of each lever arm 52*a–b* and 54*a–b* to fit around mounting post assemblies 70 and 72 and pivotally mount the arms to the support frame 12.

Each of the end members 56 and 57 are adapted in a conventional manner to receive a Bowden cable 80. Preferably, both end members 56 and 57 include a hole (not shown) for seating the cable 80 and a slot (not shown) for feeding the cable 80 into the hole. In addition, the holes can be counterbore (not shown) to receive the cable retainer 81 and ferrule 84.

The lever arms 16 are mounted to the support frame 12 by a pair of mounting post assemblies 70 and 72. Each mounting post assembly 70 and 72 includes a pin 170, 178, a center spacer 172, 180, and two end spacers 174, 176 and 182, 184, respectively. The spacers 172, 174, 176, and 180, 182, 184 are fit over the pins 170 and 178 which extend through bores 74 and 68.

A pair of torsion springs 92*a* and 92*b* are carried on mounting post assemblies 70 and 72, and extend between the lever arms and support frame 12. The torsion springs 92*a–b* function to bias the lumbar support in the retracted position.

Figure 4:
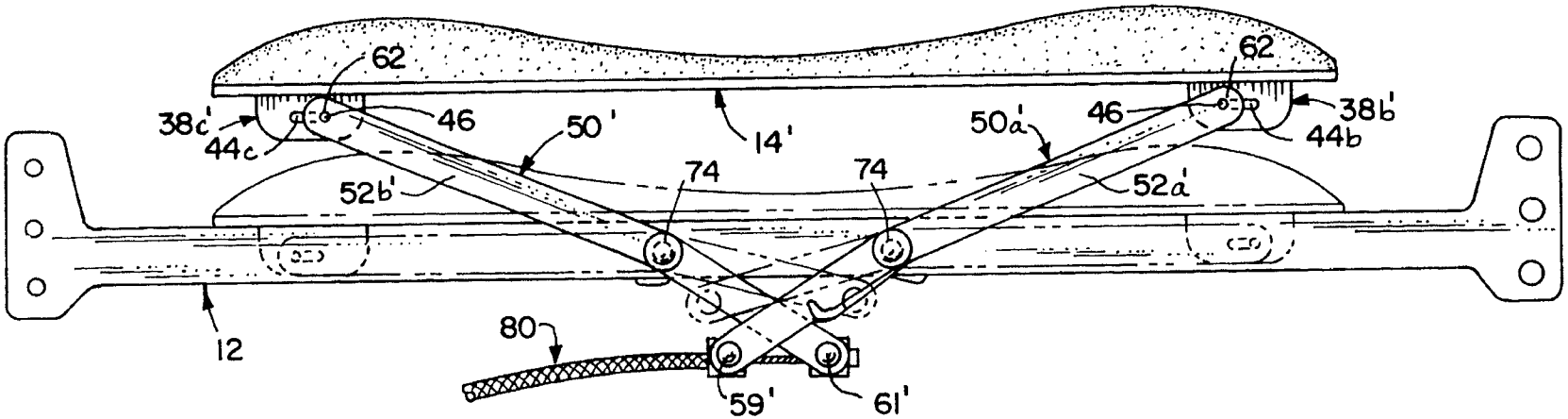
FIG. 4 is a top plan view of the lumbar support according to an alternative embodiment.
Figure 5:
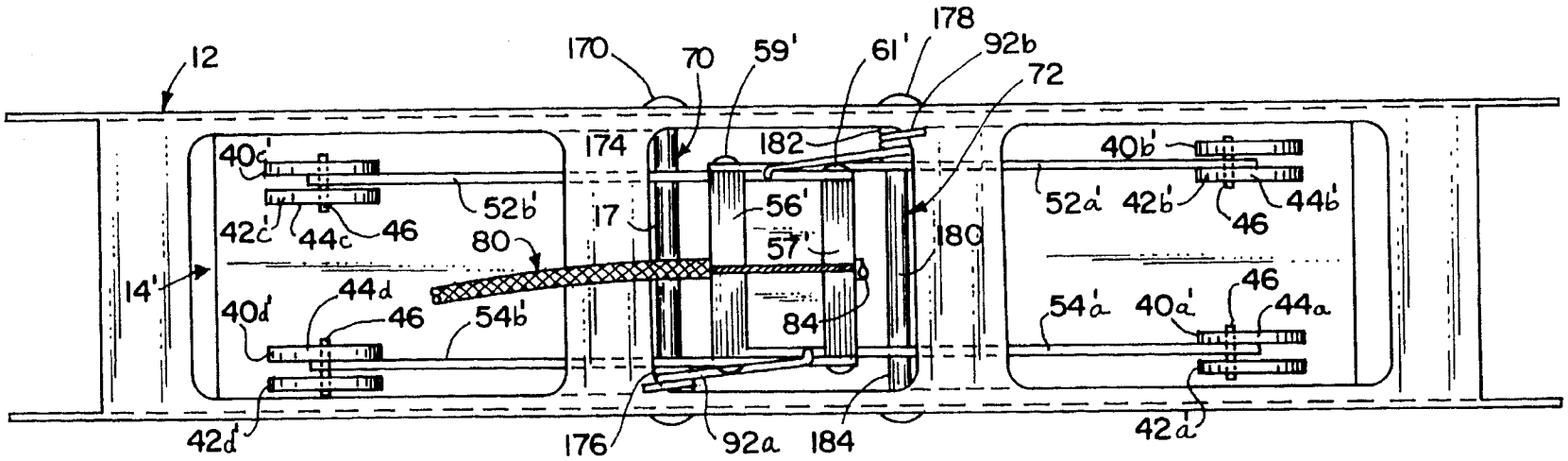
FIG. 5 is a rear view of the lumbar support according to an alternative embodiment.
Figure 6:
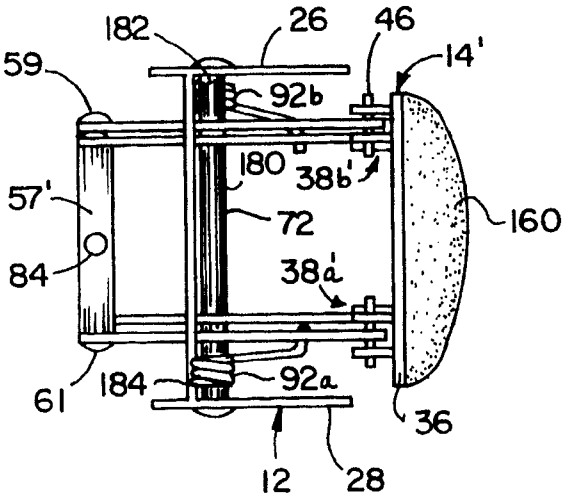
FIG. 6 is a side elevational view of the lumbar support according to an alternative embodiment.

In the alternative embodiment illustrated in FIGS. 4–6, the one-piece lever arms 50*a–b* are replaced by lever arm assemblies 50*a–b'* each having an upper arm 52*a–b'* lower arm 54*a–b'* and a pivoting end member 56' and 57'. The upper and lower arms 52*a–b'* and 54*a–b'* each include a bore (not shown) for use in assembling the lever arm assemblies 50*a–b'* as described below. The end members 56' and 57' are generally rectangular and include an internal bore (not shown) for receiving a pin 59' and 61'. The pins 59' and 61' extend through the bores formed in the end members and the upper and lower arms, and are flattened to pivotally intersecure the elements. The end members 56' and 57' are adapted to receive a Bowden cable 80 as described above in connection with end members 56 and 57.

The control mechanism 18 includes a conventional Bowden cable 80 mounted to a conventional rotary control 86. The control 86 is mounted to the seat frame in a location that is easily accessible to an individual seated in the seat. For example, FIG. 1 shows the control 86 mounted to the seat back frame 100. The Bowden cable 80 extends from the control 86 and is anchored to the end members 56 and 57 by cable retainer 81 and ferrule 84 as noted above. If desired, the rotary control 80 may be replaced by a variety of other conventional controls, including lever-actuated or motorized controls.

ASSEMBLY AND OPERATION

Prior to installation, the lever arms 16 are pivotally attached to the support platform 14 by inserting the corresponding upper and lower arms 52*a–b* and 54*a–b* into channels 48*a–d* and inserting a pin 46 into each bore 62 through slots 44*a–d*. The pins 46 secure the lever arms 16 to the support platform 14 while allowing them to move along slots 44*a–d* during extension and retraction.

In addition, the lever arms 16 are secured to the support frame 12 by inserting pins 170 and 178 through bores 68 and 74, and spacers 172, 174, 176, 180, 182, and 184. The torsion springs 92*a–b* are fit over end spacers 174 and 184. The first end of each spring 92*a–b* is hooked around the support frame 12 and the second end is hooked around the corresponding lever arm 16. Next, opposite longitudinal ends of each pin 170 and 178 are flattened against the horizontal members 18 and 20 to secure the pins in place.

After the lumbar support 10 has been assembled, it is suspended within a seat back by conventional springs 90. In a preferred embodiment, four springs 90 extend from the corners of lumbar support 10. The first end of each spring 90 hooks around the desired bore 34 in the support frame 12 while the second end extends through holes 102 in the seat back. The various bores 34 allow forward/rearward adjustment of the lumbar support with respect to the seat frame. The springs 90 allow the lumbar support 90 to move in relation to the seat back when sufficient force is applied.

Next, the control mechanism 18 is installed by mounting the control 86 to the seat back frame 100. The Bowden cable 80 mounts to the control 86 and extends to end members 56 and 57. The cable 80 is secured to the end members 56 and 57 by conventional means, such as slotted holes (not shown). When the cable 80 is properly secured, the ferrule 84 and cable retainer 81 are preferably seated within corresponding counterbores (not shown).

In operation, the control 86 is manually rotated to cause the Bowden cable 80 to extend and retract. When the cable 80 is retracted, movement of the ferrule 84 toward the sheath 82 draws the end members 56 and 57 together causing the lever arms 16 to pivot about mounting posts 70 and 72 ultimately forcing the support platform 14 away from the support frame 12. When the cable is extended, springs 92 draw the support platform 14 back toward the support frame. In this manner, actuation of the control 86 selectively moves the support platform 14 toward and away from the support frame 12. FIGS. 1, 2, and 4 show the extended support platform 14 in solid lines and the retracted platform 14 in phantom lines.

Figure 7:
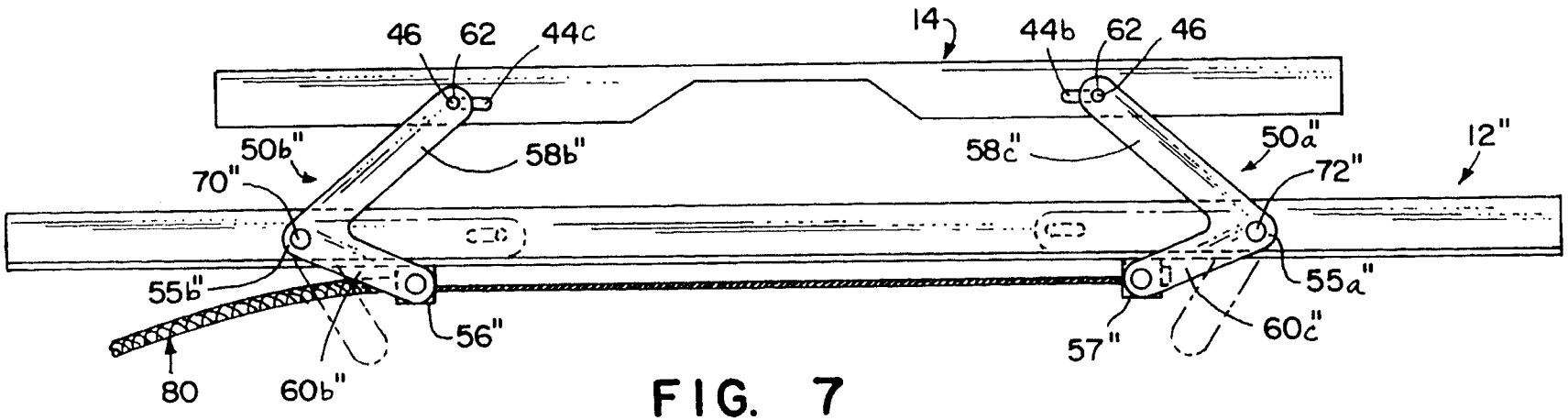
FIG. 7 is a top plan view of a second alternative embodiment.

The preferred embodiment has been described in connection with a scissor jack lever configuration. However, a variety of other lever configurations are well suited for use in the present invention. For example, in a second alternative embodiment, the lumbar support 10 is provided with a reverse lever configuration (See FIG. 7). In this embodiment, the mounting post assemblies 70" and 72" are mounted nearer to the longitudinal ends of the support frame 12" to pivotally secured two pair of reverse lever arms 50*a–b"*. Each pair of reverse lever arms 50*a–b"* includes an upper arm 52*a–b"*, a lower arm (not shown), and an end member 56" and 57" extending therebetween. Each reverse lever arms 50*a–b"* may be manufactured as a single piece or as an assembly of separate components as described in connection with the preferred embodiment. The assembly and operation of this embodiment are otherwise generally identical to that of the preferred embodiment.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A lumbar support, comprising:

a frame capable of being suspended within a seat back;

a lumbar platform;

a jack extending between said platform and said frame, said jack including a pair of intersecting one piece lever arms each including first and second arm portions meeting at a pivot portion, said pivot portions being pivotally secured to said frame at mutually distinct locations, said first arm portions being pivotally secured to said platform at one end of said lever arm; and actuator means connected to said second arm portions at another end of said lever arm for actuating said jack to selectively control the relative distance between said frame and said platform, said actuator means being operable from a location remote from said jack.

2. The lumbar support of claim 1, wherein said first and second arm portions of each of said lever arms form a dog leg.

3. The lumbar support of claim 2, further comprising a plurality of pins, one of said pins secured to each of said first legs; and wherein said support platform includes a plurality of slots each adapted to receive one of said pins whereby each of said first legs are pivotally secured to said support platform.

4. The lumbar support of claim 3, further comprising means for biasing said platform toward said support frame.

5. The lumbar support of claim 4, wherein said actuator means includes a Bowden cable and a control for selectively extending and retracting said Bowden cable.

6. A lumbar support, comprising:

a lumbar support frame capable of being mounted within a seat back;

a lumbar support platform;

lever means mounted between said lumbar support frame and said lumbar support platform for controlling the relative distance therebetween, said lever means including a pair of intersecting one piece lever arms each including first and second arm portions meeting at a pivot portion, said pivot portions being pivotally secured to said frame at mutually distinct locations, each of said first arm portions being pivotally secured to said platform at one end of said lever arm; and actuator means connected to said second arm portions at another end of said lever arm for operating said lever means to selectively control the relative distance between said lumbar support platform and said lumbar support frame, said actuator means being operable from a location remote from said jack.

7. The lumbar support of claim 6, wherein said first and second arm portions of each of said lever arms form a dog leg.

8. The lumbar support of claim 7, further comprising a plurality of pins, one of said pins secured to each of said first legs; and wherein said support platform includes a plurality of slots each adapted to receive one of said pins whereby each of said first legs are pivotally secured to said support platform.

9. The lumbar support of claim 8, further comprising a means for biasing said platform toward said support frame.

10. The lumbar support of claim 9, wherein said actuator means includes a Bowden cable and a control for selectively extending and retracting said Bowden cable.

11. The lumbar support of claim 10, wherein said lever arms are arranged to overlap one another during their entire range of motion.

12. A seat, comprising:

a seat back;

a lumbar support frame;

mounting means for mounting said support frame to said seat back;

a rigid lumbar support platform;

lever means mounted between said lumbar support frame and said lumbar support platform for controlling the relative distance therebetween, said lever means including a plurality of intersecting one piece lever arms, each of said lever arms including first and second arm portions meeting at a pivot portion, said pivot portions being pivotally secured to said frame at mutually distinct locations, said first arm portion extending at an angle to said second arm portion and secured, at one end of said lever arm, to said lumbar support platform; and actuator means for operating said lever means to selectively control the relative distance between said lumbar support platform and said lumbar support frame, said actuator means connected to said second arm portions at another end of said lever arm being operable from a location remote from said jack.

13. The seat of claim 12, wherein said first arm portions of each of said lever arms is pivotally attached to said support platform.

14. The seat of claim 13, further comprising a plurality of pins, one of said pins secured to each of said first legs; and wherein said support platform includes a plurality of slots each adapted to receive one of said pins whereby each of said first legs are pivotally secured to said support platform.

15. The seat of claim 14, wherein said actuator means includes a Bowden cable and a control for selectively extending and retracting said Bowden cable, said control being mounted to said seat back.

16. The seat of claim 15, wherein said mounting means includes a means for biasing said platform toward said support frame.

* * * * *